US008707719B2

(12) United States Patent
Yamada et al.

(10) Patent No.: US 8,707,719 B2
(45) Date of Patent: Apr. 29, 2014

(54) AIR CONDITIONER

(75) Inventors: Tsuyoshi Yamada, Sakai (JP); Tetsuya Ogasawara, Sakai (JP); Junichi Shimoda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 532 days.

(21) Appl. No.: 13/128,500

(22) PCT Filed: Nov. 13, 2009

(86) PCT No.: PCT/JP2009/006073

§ 371 (c)(1),
(2), (4) Date: May 10, 2011

(87) PCT Pub. No.: WO2010/055670

PCT Pub. Date: May 20, 2010

(65) Prior Publication Data

US 2011/0209488 A1 Sep. 1, 2011

(30) Foreign Application Priority Data

Nov. 17, 2008 (JP) ..... 2008-293141

(51) Int. Cl.
*F25D 21/06* (2006.01)

(52) U.S. Cl.
USPC ..... 62/151; 62/150; 62/156; 62/272; 62/278

(58) Field of Classification Search
USPC ..... 62/150, 151, 156, 139, 140, 272, 278
See application file for complete search history.

(56) References Cited

U.S. PATENT DOCUMENTS

2008/0190131 A1* 8/2008 Giallombardo et al. ..... 62/324.5

FOREIGN PATENT DOCUMENTS

| | | | |
|---|---|---|---|
| JP | 62-9066 | U | 1/1987 |
| JP | 4-356647 | A | 12/1992 |
| JP | 4-366341 | A | 12/1992 |
| JP | 7-43051 | A | 2/1995 |
| JP | 2002-333183 | A | 11/2002 |
| JP | 2004-233015 | A | 8/2004 |
| JP | 2007-51825 | A | 3/2007 |
| JP | 2007-255736 | A | 10/2007 |
| JP | 2008-116156 | A | 5/2008 |
| KR | 2001-0001013 | A | 1/2001 |
| KR | 2001-0089909 | A | 10/2001 |

OTHER PUBLICATIONS

International Preliminary Report of corresponding PCT Application No. PCT/JP2009/006073.
International Search Report of corresponding PCT Application No. PCT/JP-2009/006073.

* cited by examiner

*Primary Examiner* — Cheryl J Tyler
*Assistant Examiner* — Jonathan Bradford
(74) *Attorney, Agent, or Firm* — Global IP Counselors

(57) ABSTRACT

An air conditioner includes a refrigerant circuit, a switching valve, an outdoor fan and a controller. The refrigerant circuit sequentially circulates refrigerant through a compressor, an indoor heat exchanger, a decompression mechanism and an outdoor heat exchanger during a heating operation. The switching valve is connected to the refrigerant circuit to switch a flow direction of the refrigerant discharged from the compressor. The controller executes a defrosting operation control in which the outdoor fan is deactivated and the switching valve directs refrigerant discharged from the compressor towards the outdoor heat exchanger during a defrosting operation. The controller further maintains the switching valve so refrigerant discharged from the compressor is directed towards the outdoor heat exchanger and executes a fan defrosting operation control in which the outdoor fan is rotated for a predetermined period of time after completion of the defrosting operation when a predetermined condition is satisfied.

10 Claims, 7 Drawing Sheets

AIR CONDITIONER

CROSS-REFERENCE TO RELATED APPLICATONS

This U.S. National stage application claims priority under 35 U.S.C. §119 (a) to Japanese Patent Application No. 2008-293141, filed in Japan on Nov. 17, 2008, the entire contents of which are hereby incorporated herein by reference.

TECHNICAL FIELD

The present invention relates to an air conditioner using a vapor compression refrigeration cycle.

BACKGROUND ART

The outdoor heat exchangers for the air conditioners function as evaporators for refrigerant during a heating operation. Therefore, the moisture contained in outdoor air is condensed as dew on the surfaces of the outdoor heat exchangers. Especially when outdoor temperature is roughly 0 degrees Celsius, frost markedly attaches to the outdoor heat exchangers. Frost attaches not only to the outdoor heat exchangers but also to the main bodies of the outdoor fans and their peripheral members such as bell mouths and fan guards. In the air conditioners such as one disclosed in Patent Literature 1 (Japan Laid-open Patent Application Publication No. JP-A-H04-366341), hot gas is configured to flow towards the outdoor heat exchanger during a defrosting operation for melting frost covering the surfaces of the outdoor heat exchangers.

In the air conditioners such as one disclosed in Patent Literature 1, it is possible to melt the frost attaching to the outdoor heat exchangers. However, it has been difficult to even melt frost attaching to the main bodies of the outdoor fans and their peripheral members such as the bell mouths and the fan guards.

SUMMARY

Technical Problem

It is an object of the present invention to provide an air conditioner for even removing frost attaching to devices and members positioned in the downstream of the airflow exchanging heat with an outdoor heat exchanger.

Solution to Problem

An air conditioner according to a first aspect of the present invention includes a refrigerant circuit, a switching valve, an outdoor fan and a controller. The refrigerant circuit sequentially circulates a refrigerant through a compressor, an indoor heart exchanger, a decompression mechanism and an outdoor heat exchanger during a heating operation. The switching valve is connected to the refrigerant circuit for switching a flow direction of the refrigerant discharged from the compressor. The outdoor fan blows the air towards the outdoor heat exchanger. The controller is configured to execute a defrosting operation control of deactivating the outdoor fan and causing the switching valve to direct the refrigerant discharged from the compressor towards the outdoor heat exchanger during a defrosting operation. Further, the controller is configured to keep the operation of directing the refrigerant discharged from the compressor towards the outdoor heat exchanger and execute a fan defrosting operation control of rotating the outdoor fan for a predetermined period of time after completion of the defrosting operation when a predetermined condition is satisfied.

Under predetermined conditions, frost attaching to the main body of the outdoor fan and its peripheral members (e.g., a bell mouth and a fan guard) does not melt even after completion of the defrosting operation. According to the air conditioner of the first aspect of the present invention, however, air elevates its temperature when passing through the outdoor heat exchanger and the warm air hits the main body of the outdoor fan and its peripheral members by means of rotations of the outdoor fan. Therefore, frost attaching thereto melts.

An air conditioner according to a second aspect of the present invention is the air conditioner according to the first aspect of the present invention. The air conditioner further includes an outdoor temperature sensor measuring an outdoor temperature. The controller is configured to execute the fan defrosting operation control when the outdoor temperature detected through the outdoor temperature sensor falls in a predetermined temperature range. According to the air conditioner of the second aspect of the present invention, the controller is configured to determine whether or not the fan defrosting operation control is executed depending on outdoor temperature. Therefore, the fan defrosting operation is prevented from being executed uselessly.

An air conditioner according to a third aspect of the present invention is the air conditioner according to the first aspect of the present invention. In the air conditioner, the controller is configured to activate the compressor during the fan defrosting operation control. According to the air conditioner of the third aspect of the present invention, the refrigerant flowing into the outdoor heat exchanger keeps its temperature high by means of activation of the compressor during the fan defrosting operation control. Therefore, reduction in temperature is inhibited for the warm air flowing towards the main body of the outdoor fan and its peripheral members. Consequently, a performance of defrosting the main body of the outdoor fan and its peripheral members is enhanced.

An air conditioner according to a fourth aspect of the present invention is the air conditioner according to the first aspect of the present invention. In the air conditioner, the controller is configured to activate the compressor during the fan defrosting operation control at a specific operating frequency lower than an operating frequency during the defrosting operation. According to the air conditioner of the fourth aspect of the present invention, a low operating frequency is preferably set for the compressor during the fan defrosting operation, for instance, when pressure is equalized within the refrigerant circuit after the fan defrosting operation. Therefore, actions after the fan defrosting operation will be smoothly executed by setting a specific operating frequency for the compressor in preparation for the actions after the fan defrosting operation.

An air conditioner according to a fifth aspect of the present invention is the air conditioner according to the first aspect of the present invention. In the air conditioner, the predetermined period of time is allowed to be selected from options at least in an initial setting at an installation site of the air conditioner. According to the air condition of the fifth aspect of the present invention, the period of time for executing the fan defrosting operation control is set to be suitable for a climate condition of the installation site of the air conditioner. Therefore, such a situation is avoided that frost remains on the main body of the outdoor fan and its peripheral members after the fan defrosting operation control.

An air conditioner according to a sixth aspect of the present invention is the air conditioner according to one of the third and fourth aspects of the present invention. In the air conditioner, the controller is configured to deactivate the compressor after completion of the fan defrosting operation control and before switching to the heating operation. According to the air conditioner of the sixth aspect of the present invention, the compressor is deactivated before starting of the heating operation. Therefore, pressure is equalized within the refrigerant circuit and switching to the heating operation is safely executed.

An air conditioner according to a seventh aspect of the present invention is the air conditioner according to one of the third and fourth aspects of the present invention. The air conditioner further includes a refrigerant heating device configured to heat the refrigerant flowing through the refrigerant circuit. In the air conditioner, the controller is configured to activate the refrigerant heating device during the fan defrosting operation control.

According to the air conditioner of the seventh aspect of the present invention, the refrigerant flowing into the outdoor heat exchanger keeps its temperature high by means of activation of the refrigerant heating device during the fan defrosting operation control. Therefore, reduction in temperature is inhibited for the warm air flowing towards the main body of the outdoor fan and its peripheral members. Consequently, a performance of defrosting the main body of the outdoor fan and its peripheral members is enhanced.

An air conditioner according to an eighth aspect of the present invention is the air conditioner according to the seventh aspect of the present invention. In the air conditioner, the refrigerant heating device is an electromagnetic induction heater. According to the air conditioner of the eighth aspect of the present invention, the pipes are directly heated. Therefore, the refrigerant increases its temperature elevating speed.

Advantageous Effects of Invention

According to the air conditioner of the first aspect of the present invention, air elevates its temperature when passing through the outdoor heat exchanger and the warm air hits the main body of the outdoor fan and its peripheral members by means of rotations of the outdoor fan. Therefore, frost attaching thereto melts.

According to the air conditioner of the second aspect of the present invention, the controller is configured to determine whether or not the fan defrosting operation control is executed depending on outdoor temperature. Therefore, the fan defrosting operation is prevented from being executed uselessly.

According to the air conditioner of the third aspect of the present invention, the refrigerant flowing into the outdoor heat exchanger keeps its temperature high by means of activation of the compressor during the fan defrosting operation control. Therefore, reduction in temperature is inhibited for the warm air flowing towards the main body of the outdoor fan and its peripheral members. Consequently, a performance of defrosting the main body of the outdoor fan and its peripheral members is enhanced.

According to the air conditioner of the fourth aspect of the present invention, a specific operating frequency is set for the compressor in preparation for the actions after the fan defrosting operation. Therefore, the actions after the fan defrosting operation will be smoothly executed.

According to the air conditioner of the fifth aspect of the present invention, the period of time for executing the fan defrosting operation control is set to be suitable for a climate condition of the installation site of the air conditioner. Therefore, such a situation is avoided that frost remains on the main body of the outdoor fan and its peripheral members after the fan defrosting operation control.

According to the air conditioner of the sixth aspect of the present invention, the compressor is configured to be activated during the fan defrosting operation control but is configured to be deactivated before starting of the heating operation. Therefore, pressure is equalized within the refrigerant circuit and switching to the heating operation is safely executed.

According to the air conditioner of the seventh aspect of the present invention, the performance of defrosting the main body of the outdoor fan and its peripheral members is enhanced.

According to the air conditioner of the eighth aspect of the present invention, the pipes are directly heated. Therefore, the refrigerant increases its temperature elevating speed.

DESCRIPTION OF EMBODIMENTS

An exemplary embodiment of the present invention will be explained with reference to figures. It is noted that the following embodiment is an illustrative embodiment of the present invention and is not intended to limit the technical scope of the present invention.

<Air Conditioner>

Figure 1:
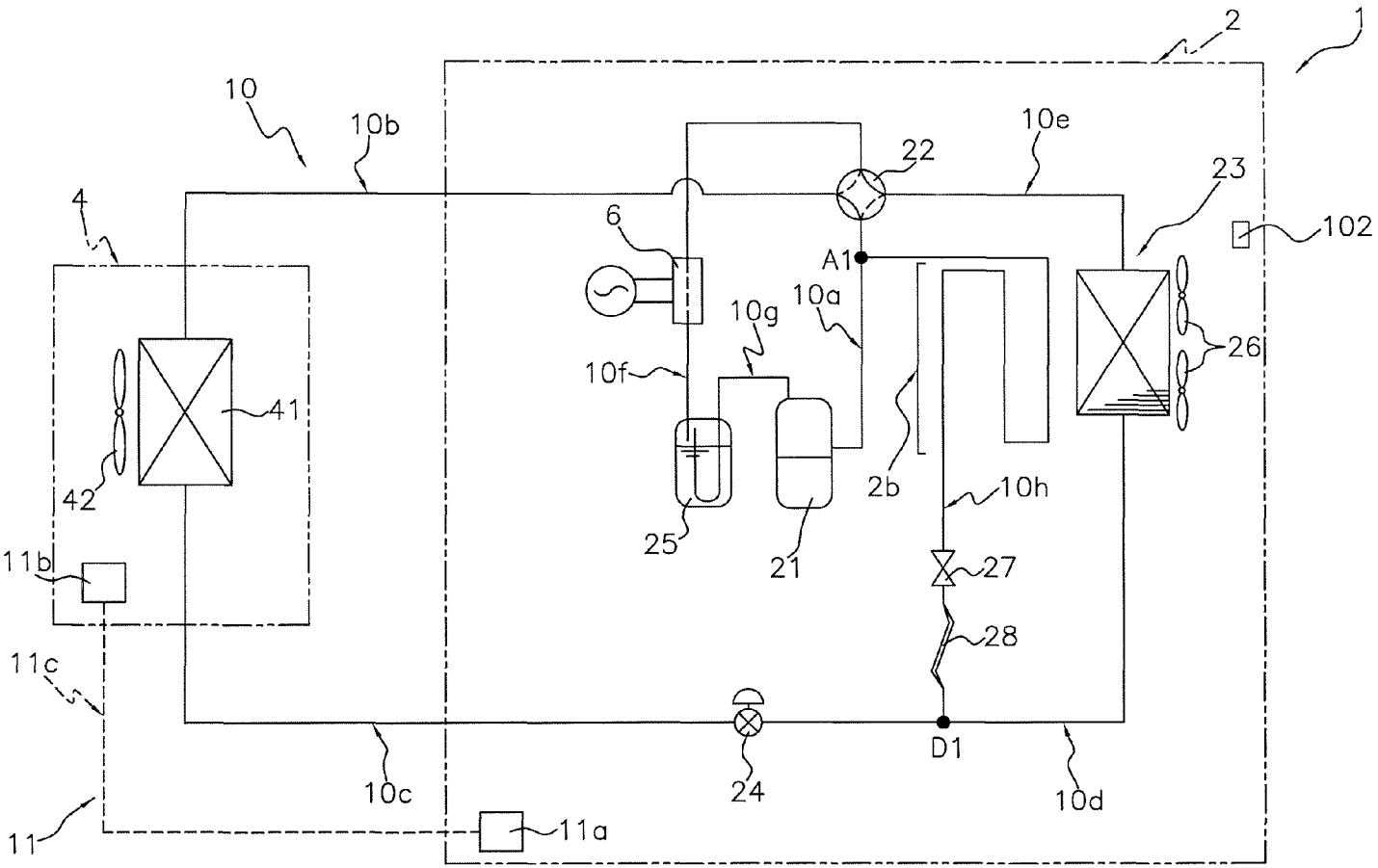
FIG. 1 is a refrigeration circuit diagram of an air conditioner according to an exemplary embodiment of the present invention.

FIG. 1 is a configuration diagram of an air conditioner according to an exemplary embodiment of the present invention. In the air conditioner 1 of FIG. 1, an outdoor unit 2 as a heat source side device and an indoor unit 4 as a user side device are connected through a refrigerant piping and a refrigerant circuit 10 is thereby formed for executing a vapor compression refrigeration cycle.

The outdoor unit 2 accommodates a compressor 21, a four-way switching valve 22, an outdoor heat exchanger 23, an expansion valve 24, an accumulator 25, outdoor fans 26, a hot gas bypass valve 27, a capillary tube 28 and an electromagnetic induction heating unit 6. The indoor unit 4 accommodates an indoor heat exchanger 41 and an indoor fan 42.

The refrigerant circuit 10 includes a discharge pipe 10*a*, a gas pipe 10*b*, a liquid pipe 10*c*, an outdoor liquid pipe 10*d*, an outdoor gas pipe 10*e*, an accumulation pipe 10*f*, a suction pipe 10*g* and a hot gas bypass 10*h*.

The discharge pipe 10*a* connects the compressor 21 and the four-way switching valve 22. The gas pipe 10*b* connects the four-way switching valve 22 and the indoor heat exchanger 41. The liquid pipe 10*c* connects the indoor heat exchanger 41 and the expansion valve 24. The outdoor liquid pipe 10*d* connects the expansion valve 24 and the outdoor heat exchanger 23. The outdoor gas pipe 10*e* connects the outdoor heat exchanger 23 and the four-way switching valve 22.

The accumulation pipe 10*f* connects the four-way switching valve 22 and the accumulator 25. The electromagnetic induction heating unit 6 is attached to a part of the accumulation pipe 10*f*. The accumulation pipe 10*f* is a copper pipe and at least a heated portion thereof, covered with the electromagnetic induction heating unit 6, is enclosed by a stainless steel pipe. Excluding the stainless steel pipe, the other pipes forming the refrigerant circuit 10 are copper pipes.

The suction pipe 10*g* connects the accumulator 25 and the suction side of the compressor 21. The hot gas bypass 10*h* connects a branch point A1 disposed in an intermediate portion of the discharge pipe 10*a* and a branch point D1 disposed in an intermediate portion of the outdoor liquid pipe 10*d*.

The hot gas bypass valve 27 is disposed in an intermediate portion of the hot gas bypass 10*h*. A controller 11 is configured to open and close the hot gas bypass valve 27 for switching the hot gas bypass 10*h* between a refrigerant circulation permission state and a refrigerant circulation prohibition state. Further, the capillary tube 28 is disposed in the downstream of the hot gas bypass valve 27 in order to reduce the cross-sectional area of the circulation path of the refrigerant. During a defrosting operation, the refrigerant ratio is thereby kept constant between the refrigerant circulating the outdoor heat exchanger 23 and the refrigerant circulating the hot gas bypass 10*h*.

The four-way switching valve 22 is allowed to switch between a cooling operation cycle and a heating operation cycle. FIG. 1 depicts a connected state for executing the heating operation with a solid line and depicts a connected state for executing the cooling operation with a dotted line. During the heating operation, the indoor heat exchanger 41 functions as a condenser whereas the outdoor heat exchanger 23 functions as an evaporator. During the cooling operation, the outdoor heat exchanger 23 functions as a condenser whereas the indoor heat exchanger 41 functions as an evaporator.

The outdoor fans 26 are disposed in the vicinity of the outdoor heat exchanger 23 in order to supply outdoor air to the outdoor heat exchanger 23. The indoor fan 42 is disposed in the vicinity of the indoor heat exchanger 41 in order to supply indoor air to the indoor heat exchanger 41.

The controller 11 includes an outdoor control unit 11*a* and an indoor control unit 11*b*. The outdoor and indoor control units 11*a* and 11*b* are connected through a communication line 11*c*. Further, the outdoor control unit 11*a* is configured to control devices disposed within the outdoor unit 2 whereas the indoor control unit 11*b* is configured to control devices disposed within the indoor unit 4.

(External Appearance of Outdoor Unit)

Figure 2:
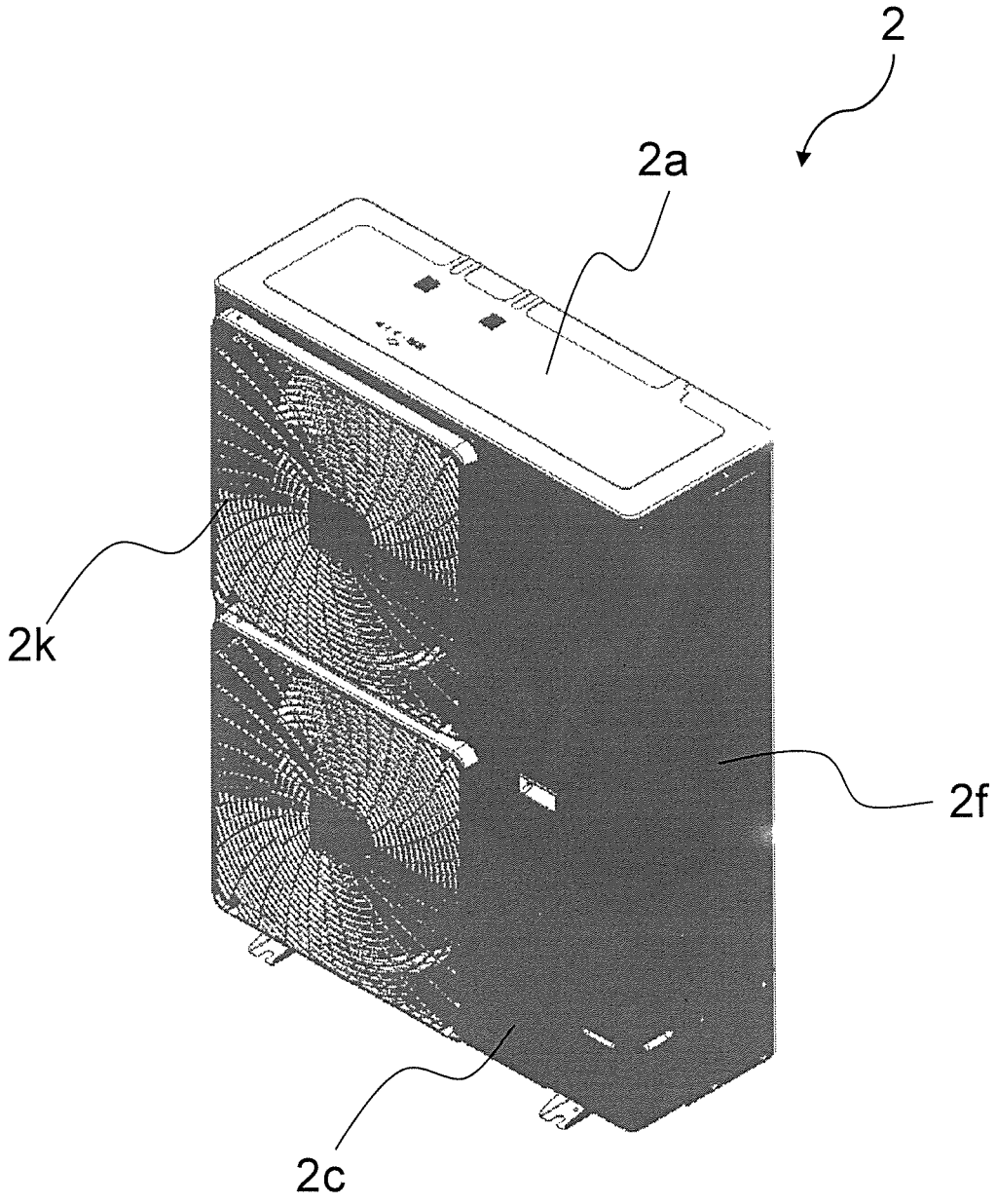
FIG. 2 is an external perspective view of an outdoor unit seen from the front side thereof.

FIG. 2 is an external perspective view of the outdoor unit seen from its front side.

In FIG. 2, the outer shell of the outdoor unit 2 is formed in a generally rectangular cuboid shape by a top plate 2*a*, a bottom plate (not visible in the figure) opposed to the top plate 2*a*, a front panel 2*c*, fan guards 2*k*, a right side panel 2*f*, a left side panel (not visible in the figure) opposed to the right side panel 2*f* and a rear panel (not visible in the figure) opposed to the front panel 2*c* and the fan guards 2*k*.

(Inside of Outdoor Unit)

Figure 3:
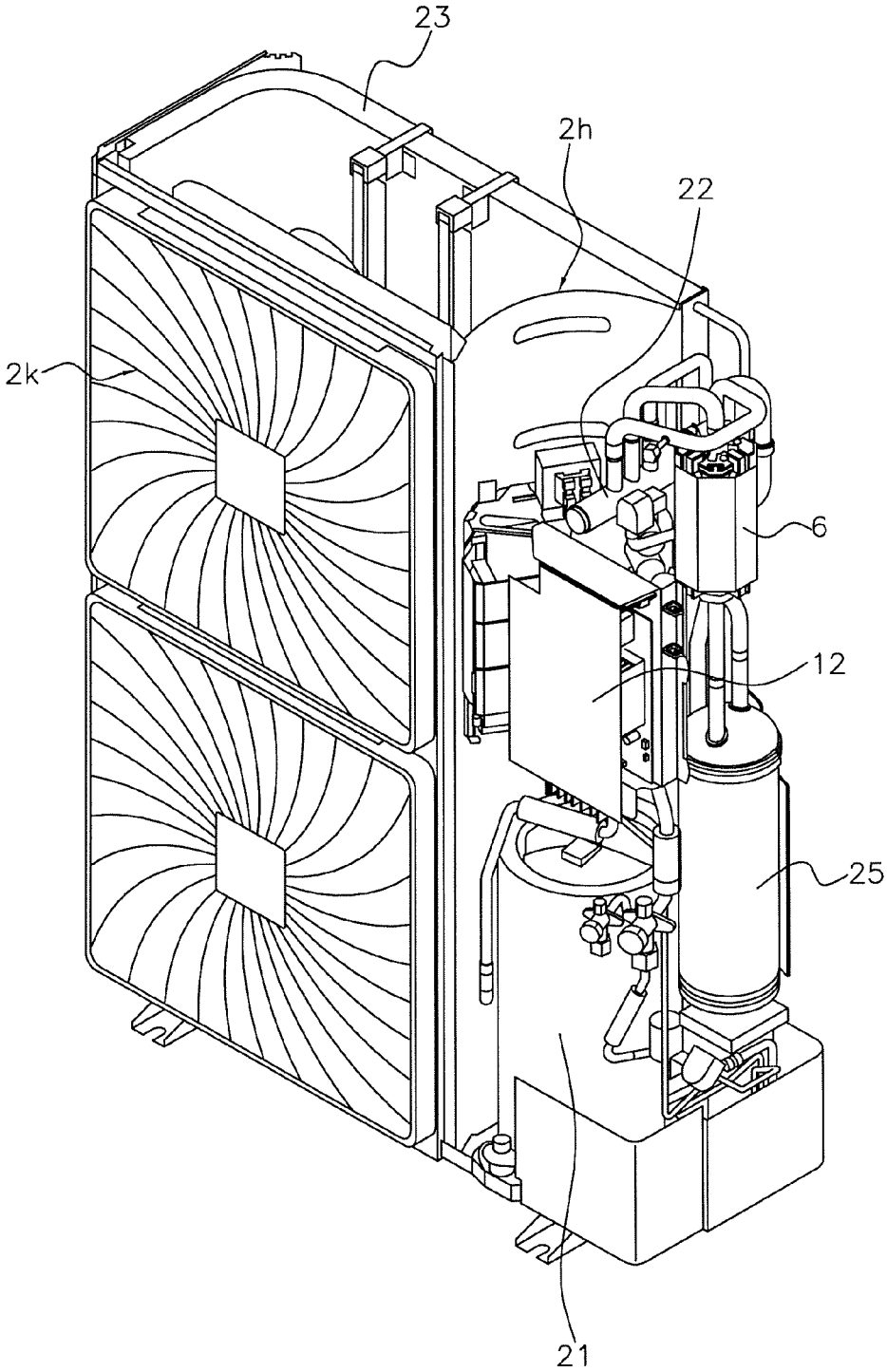
FIG. 3 is a perspective view of the outdoor unit that a front panel, a right side panel and a rear panel are removed therefrom.

FIG. 3 is a perspective view of the outdoor unit that the front panel, the right side panel and the rear panel are removed therefrom. In FIG. 3, the outdoor unit 2 is segmented into a fan room and a machine room through a partition plate 2*h*. The fan room accommodates the outdoor heat exchanger 23 and outdoor fans (not illustrated in the figure) whereas the machine room accommodates the electromagnetic induction heating unit 6, the compressor 21 and the accumulator 25.

Figure 4:
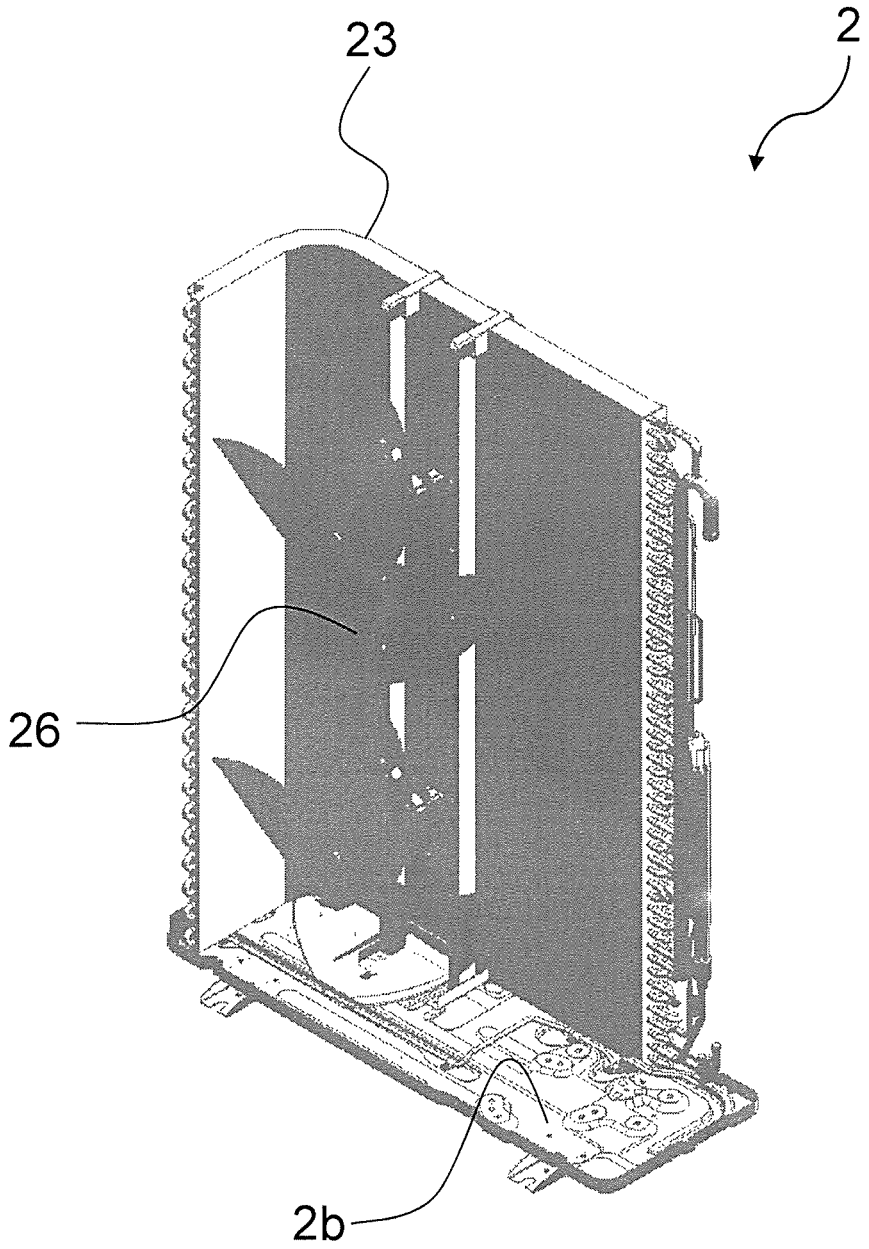
FIG. 4 is a perspective view of the outdoor unit that members are removed therefrom excluding a bottom plate, an outdoor heat exchanger and outdoor fans.

FIG. 4 is a perspective view of the outdoor unit that members are removed therefrom excluding the bottom plate, the outdoor heat exchanger and the outdoor fans. In FIG. 4, the outdoor heat exchanger 23 is a fin and tube heat exchanger molded in an L shape. Two sets of the outdoor fans 26 are disposed vertically adjacent to each other through a support base while being disposed between the fan guards 2*k* (see FIG. 3) and the outdoor heat exchanger 23. When the outdoor fans 26 rotate, the outdoor air is sucked through the air holes of the left side panel and the rear panel, passes through the fins of the outdoor heat exchanger 23, and is blown out of the fan guards 2*k*.

(Structures of Bottom Plate and its Periphery in Outdoor Unit)

Figure 5:
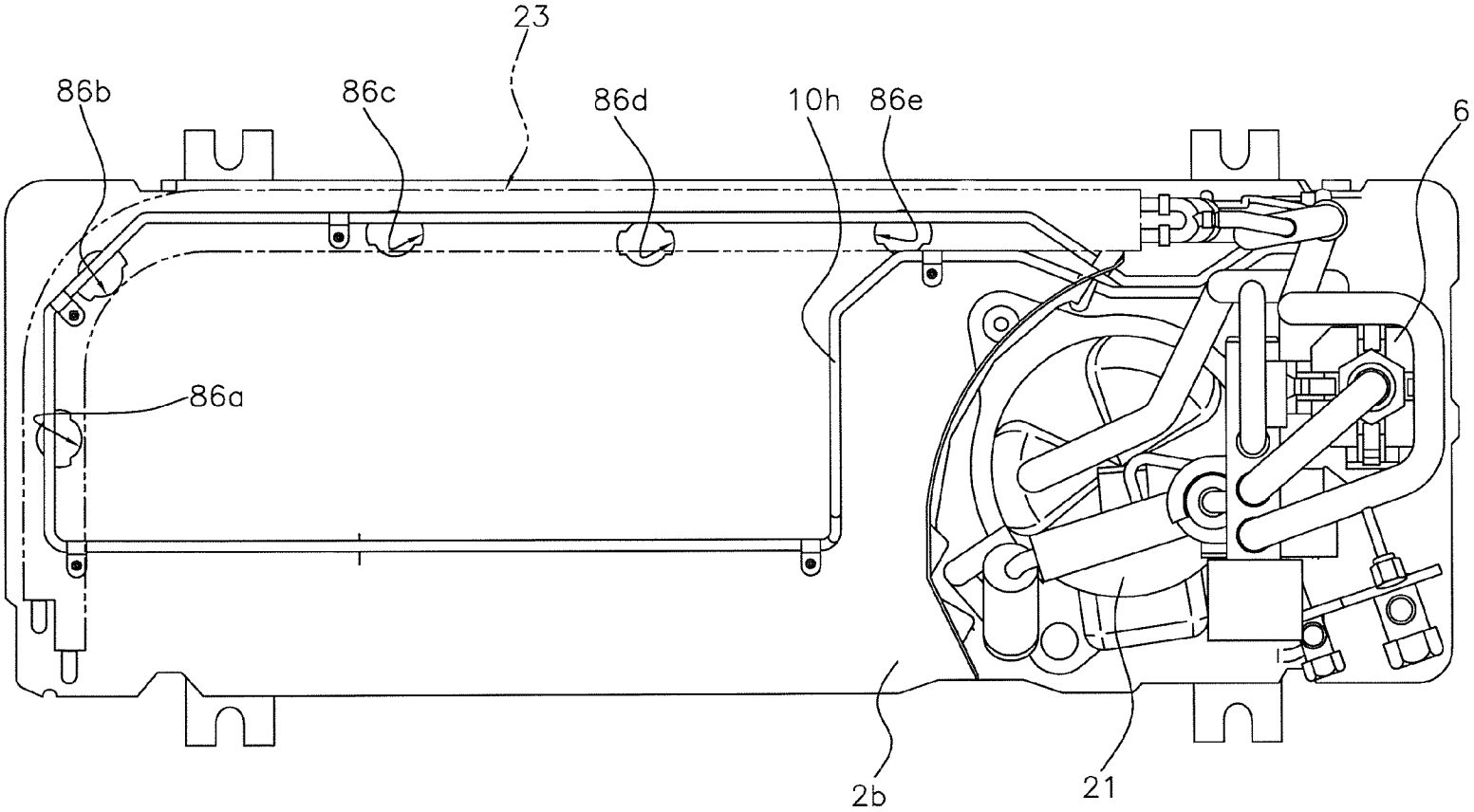
FIG. 5 is a plan view of the outdoor unit that members are removed therefrom excluding the bottom plate and a machine room.

FIG. 5 is a plan view of the outdoor unit that members are removed therefrom excluding the bottom plate and the machine room. It should be noted that FIG. 5 depicts the outdoor heat exchanger 23 with a two-dotted dashed line for easy understanding of the position of the outdoor heat exchanger 23. The hot gas bypass 10*h* is disposed on the bottom plate 2*b*. The hot gas bypass 10*h* is extended to the fan room from the machine room where the compressor 21 is positioned, then circulates the bottom of the fan room, and returns to the machine room. Roughly half the entire length of the hot gas bypass 10*h* is positioned under the outdoor heat exchanger 23. Further, a part of the bottom plate 2*b*, positioned under the outdoor heat exchanger 23, includes drainage ports 86*a* to 86*e* penetrating the bottom plate 2*b* along the thickness direction of the bottom plate 2*b*.

(Electromagnetic Induction Heating Unit)

Figure 6:
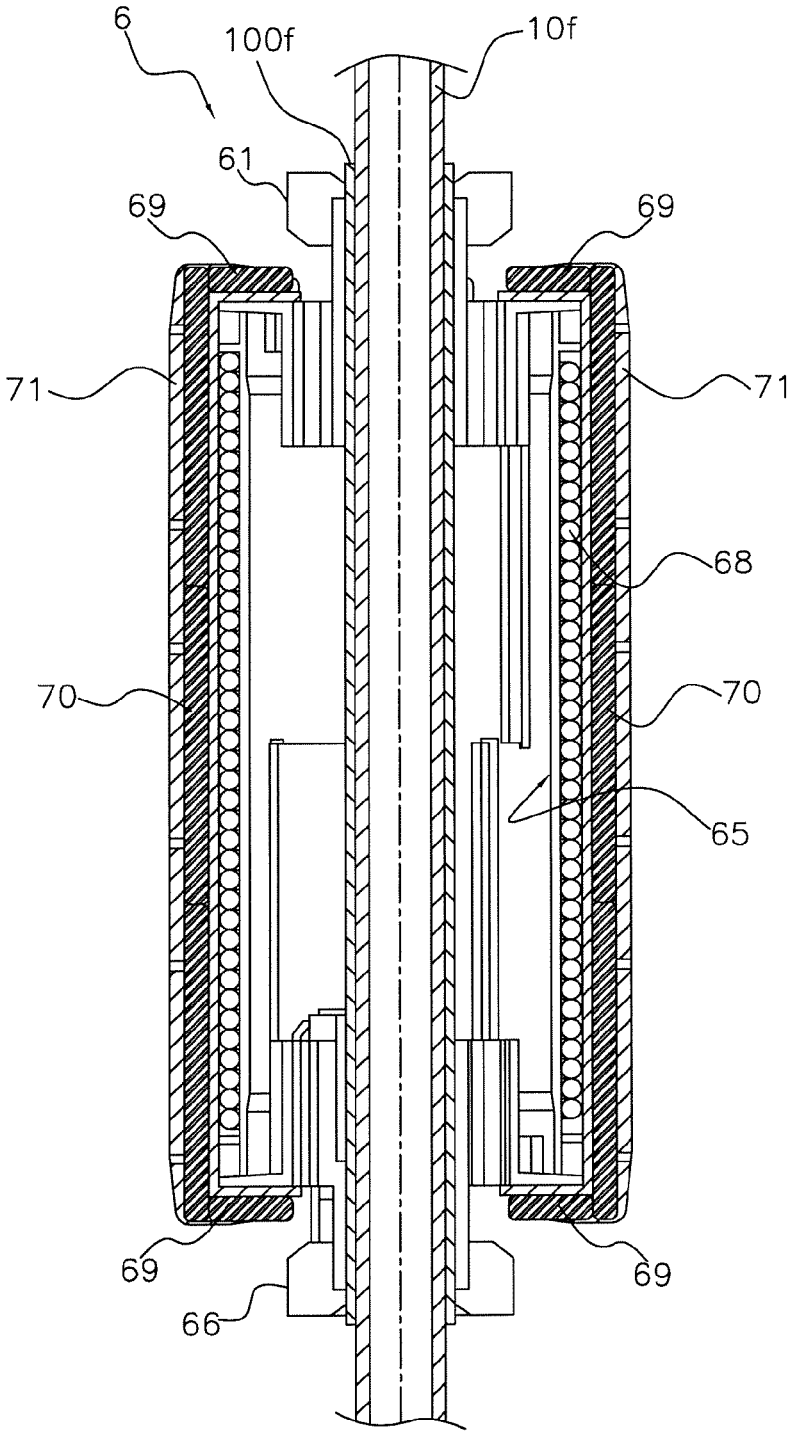
FIG. 6 is a cross-sectional view of an electromagnetic induction heating unit.

FIG. 6 is a cross-sectional view of the electromagnetic induction heating unit. In FIG. 6, the electromagnetic induction heating unit 6 is disposed for covering the radial outside of the heated portion of the accumulation pipe 10*f*. The electromagnetic induction heating unit 6 is configured to heat the heated portion by means of electromagnetic induction heating. The heated portion of the accumulation pipe 10*f* has a double pipe structure of an inner copper pipe and an outer stainless steel pipe 100*f*. Either ferrite stainless containing chromium of 16 to 18% or precipitation hardening stainless containing nickel of 3 to 5%, chromium of 15 to 17.5% and copper of 3 to 5% is selected as the stainless material used for the stainless steel pipe 100*f*.

First, the electromagnetic induction heating unit 6 is appropriately positioned with respect to the accumulation pipe 10*f*. Next, the top peripheral part of the electromagnetic induction heating unit 6 is fixed to the accumulation pipe 10*f* by means of a first hexagonal nut 61. Finally, the bottom peripheral part of the electromagnetic induction heating unit 6 is fixed to the accumulation pipe 10*f* by means of a second hexagonal nut 66.

A coil 68 is helically wrapped about the outer periphery of a bobbin body 65. The coil 68 is accommodated in the inside of a ferrite case 71. The ferrite case 71 further accommodates first ferrite parts 69 and a second ferrite part 70.

The first ferrite parts 69 are formed by molding ferrite with a high magnetic permeability. When the coil 68 is electrified, the first ferrite parts 69 form a path for magnetic fluxes together with the stainless steel pipe 100*f*. The first ferrite parts 69 are disposed on the both axial ends of the ferrite case 71.

The position and shape of the second ferrite part 70 are different from those of the first ferrite parts 69. However, the function of the second ferrite part 70 is roughly the same as that of the first ferrite parts 69. The second ferrite part 70 is disposed in the vicinity of the outer periphery of the bobbin body 65 within the accommodation part of the ferrite case 71.

<Actions of Air Conditioner>

The air conditioner 1 is allowed to switch back and forth between a cooling operation and a heating operation using the four-way switching valve 22.

(Cooling Operation)

During the cooling operation, the four-way switching valve 22 is set to be in a state depicted with the dotted line in FIG. 1. When the compressor 21 is operated under the condition, a vapor compression refrigeration cycle is executed in the refrigerant circuit 10 where the outdoor heat exchanger 23 functions as a condenser and the indoor heat exchanger 41 functions as an evaporator.

The high pressure refrigerant, discharged from the compressor 21, exchanges heat with the outdoor air in the outdoor heat exchanger 23, and is thereby condensed. After passing through the outdoor heat exchanger 23, the refrigerant is decompressed while passing through the expansion valve 24. The decompressed refrigerant subsequently exchanges heat with the indoor air in the indoor heat exchanger 41, and is thereby evaporated. The indoor air lowers its temperature through the heat exchange with the refrigerant, and is blown out to an air conditioning target space. After passing through the indoor heat exchanger 41, the refrigerant is sucked into the compressor 21 and is therein compressed.

(Heating Operation)

During the heating operation, the four-way switching valve 22 is set to be in a state depicted with the solid line in FIG. 1. When the compressor 21 is operated under the condition, a vapor compression refrigeration cycle is executed in the refrigerant circuit 10 where the outdoor heat exchanger 23 functions as an evaporator and the indoor heat exchanger 41 functions as a condenser.

The high pressure refrigerant, discharged from the compressor 21, exchanges heat with the indoor air in the indoor heat exchanger 41, and is therein condensed. The indoor air elevates its temperature through the heat exchange with the refrigerant, and is blown out to the air conditioning target space. The condensed refrigerant is decompressed while passing through the expansion valve 24. The decompressed refrigerant subsequently exchanges heat with the outdoor air in the outdoor heat exchanger 23, and is therein evaporated. After passing through the outdoor heat exchanger 23, the refrigerant is sucked into the compressor 21 and is therein compressed.

In the activation of the heating operation, especially when the compressor 21 is not sufficiently warmed up, the compressor 21 can compress the refrigerant in a heated state by heating the accumulation pipe **10*f* using the electromagnetic induction heating unit 6. Consequently, the gas refrigerant to be discharged from the compressor 21** elevates its temperature, and the lack of heating performance is thereby compensated in the activation of the heating operation.

(Defrosting Operation)

When the heating operation is executed, moisture contained in the air is condensed as dew on the surface of the outdoor heat exchanger 23. The condensed dew is changed into frost or ice and covers the surface of the outside heat exchanger. The heat exchange performance of the heat exchanger is thereby reduced. The defrosting operation is therefore executed for melting the frost or ice attaching to the outdoor heat exchanger 23. The defrosting operation is configured to be executed in the same cycle as that of the cooling operation.

The high pressure refrigerant, discharged from the compressor 21, exchanges heat with the outdoor air in the outdoor heat exchanger 23, and is thereby condensed. The heat released from the refrigerant melts the frost or ice covering the outdoor heat exchanger 23. The refrigerant, condensed as a result of the heat release, is decompressed while passing through the expansion valve 24. The decompressed refrigerant subsequently exchanges heat with the indoor air in the indoor heat exchanger 41, and is thereby evaporated. The indoor fan 42 is herein kept deactivated. This is because comfortableness is deteriorated by cooled air to be brown out to the air conditioning target space when the indoor fan 42 is activated. After passing through the indoor heat exchanger 41, the refrigerant is sucked into the compressor 21 and is therein compressed.

Further, during the defrosting operation, the compressor 21 can compress the refrigerant in a heated state by heating the accumulation pipe **10*f* using the electromagnetic induction heating unit 6. Consequently, the gas refrigerant to be discharged from the compressor 21** elevates its temperature, and the defrosting performance is thereby enhanced.

Yet further, during the defrosting operation, the high pressure refrigerant, discharged from the compressor 21, also flows through the hot gas bypass **10*h*. Even when growing on the bottom plate 2*b* of the outdoor unit 2, frost or ice melts by means of the heat released from the refrigerant passing through the hot gas bypass 10*h*. Water herein produced is discharged through the drainage ports 86*a* to 86*e*. Further, the drainage ports 86*a* to 86*e* are also heated by the hot gas bypass 10*h*. Therefore, the drainage ports 86*a* to 86*e*** are prevented from being clogged by the frozen moisture.

<Other Actions of Air Conditioner>

(Fan Defrosting Operation)

A fan defrosting operation refers to an operation of causing the outdoor fans 26 to rotate for a predetermined period of time after completion of the defrosting operation in order to melt the frost attaching to the main bodies of the outdoor fans 26 and their peripheral members by means of the air having passed through the outdoor heat exchanger 23. The fan defrosting operation will be hereinafter explained with reference to the figures.

Figure 7:
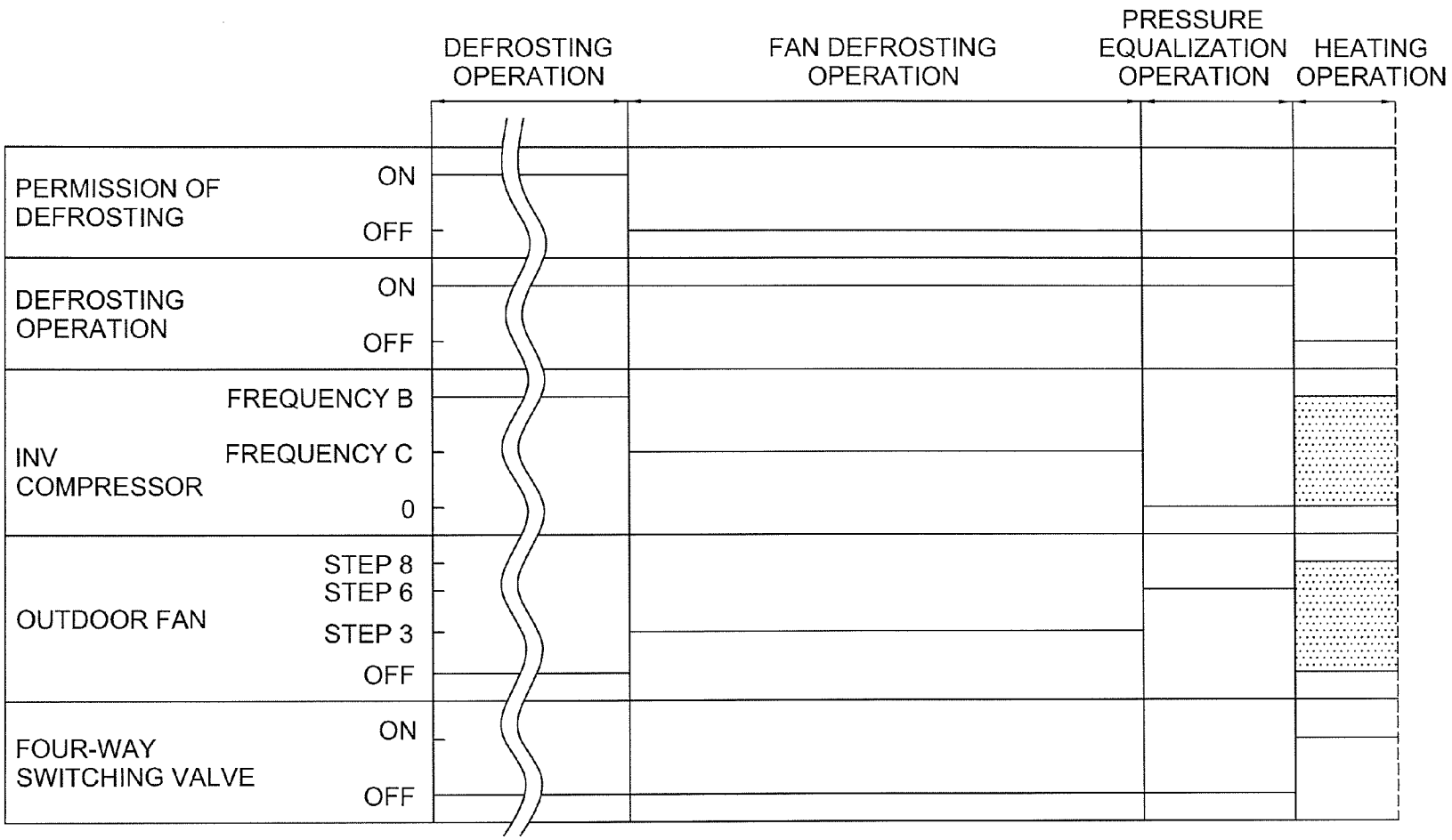
FIG. 7 is a time chart of a fan defrosting operation and its preceding and succeeding operations for the air conditioner.
Figure 2:
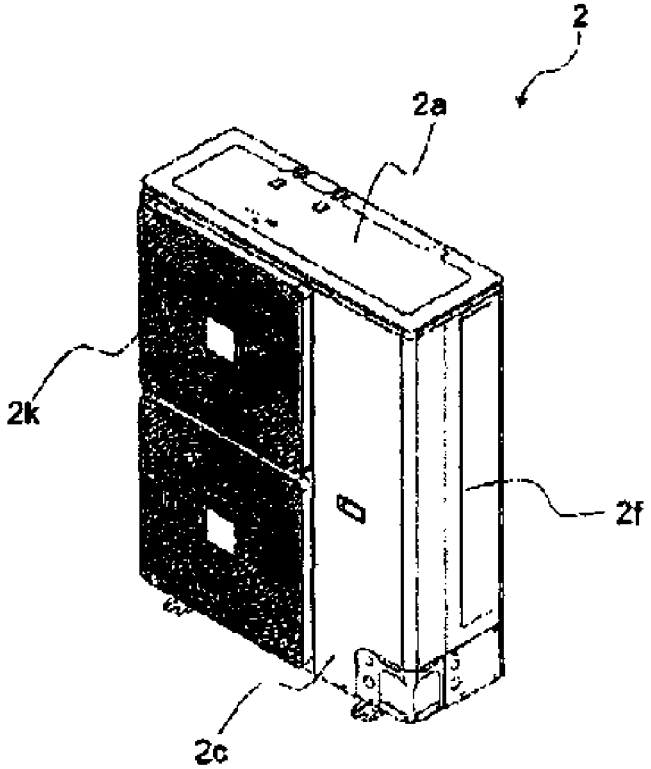
Figure 4:
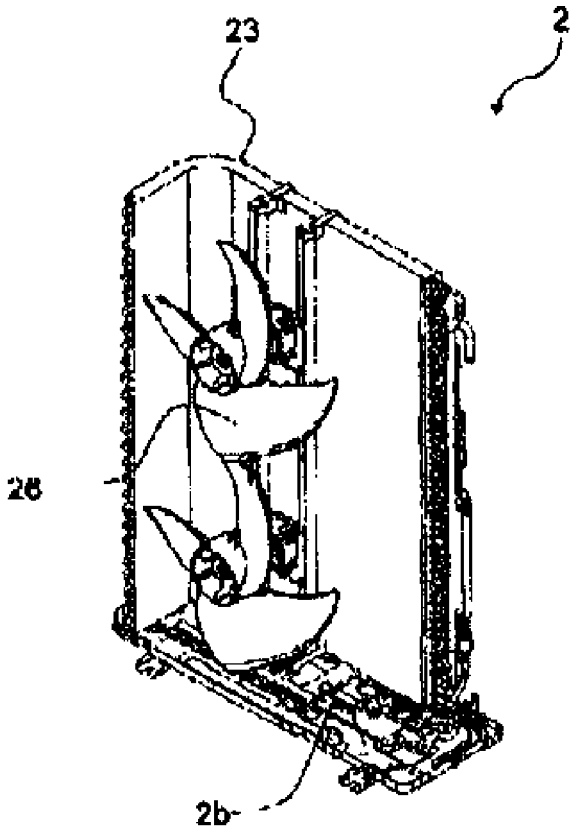

FIG. 7 is a time chart of the fan defrosting operation and its preceding and succeeding operations for the air conditioner. In FIG. 7, the fan defrosting operation is configured to be executed for a predetermined period of time by maintaining the refrigerant cycle of the defrosting operation and setting the compressor 21 to have a specific operating frequency lower than the operating frequency during the defrosting operation. The predetermined period of time is set to be suitable for the climate condition of the installation site of the air conditioner. Specifically, three stages of 60, 80 and 100 seconds are available for the settings of the predetermined period of time. Any of the stages is set as the predetermined period of time by operating a setting button in the installation of the air conditioner 1. Consequently, a situation is avoided that frost remains on the main bodies of the outdoor fans 26 and their peripheral members after the fan defrosting operation control. In the installation of the air conditioner 1, however, such a setting is also available that prevents the air conditioner 1 from executing the fan defrosting operation. Alternatively, the predetermined period of time can be set anytime excluding in the installation of the air conditioner 1.

Further, execution/non-execution of the fan defrosting operation also can be set anytime excluding in the installation of the air conditioner 1.

During the fan defrosting operation, the outdoor fans 26 rotate at a relatively low rotation speed. The rotation speed of the outdoor fans 26 can be switched in a range of steps 1 to 8 (excluding deactivation). The third lowest step 3 is selected during the fan defrosting operation. It should be noted the outdoor fans 26 are deactivated during the defrosting operation to be executed before the fan defrosting operation.

The fan defrosting operation is not always executed but is executed only when a predetermined condition is satisfied immediately before the start of the defrosting operation. The defrosting operation is normally executed under the condition that a predetermined period of time elapses after the previous defrosting operation and both of the outdoor temperature and the outdoor heat exchanger temperature are lower than or equal to a preliminarily set temperature. On the other hand, the fan defrosting operation is executed after completion of the defrosting operation when the outdoor temperature immediately before the start of the defrosting operation falls in a range of −5 to 5 degrees Celsius. It should be noted that the outdoor temperature is measured through an outdoor temperature sensor 102 attached to the outdoor unit 2.

For example, frost attaches not only to the outdoor heat exchanger 23 but also to the fan guards 2*k* when the heating operation is executed under a high-humidity and low-temperature (roughly 0 degrees Celsius) circumstance. In the present exemplary embodiment, the outdoor fans 26 are propeller fans. When each outdoor fan 26 is of a type including a bell mouth in the surrounding of the propeller fan, frost also attaches to the bell mouth. Alternatively when each outdoor fan 26 is a turbo fan, frost also attaches to a fan blade. Even when the defrosting operation is completed under the condition, this results in only melting of the frost attaching to the outdoor heat exchanger 23 and does not result in melting of the frost attaching to, for instance, the fan guards 2*k* disposed in the surrounding of the outdoor fans 26. According to the present exemplary embodiment, however, the outdoor fans 26 are activated by the fan defrosting operation. The air warmed by the outdoor heat exchanger 23 is supplied to the main bodies of the outdoor fans 26 and the peripheral members of the main bodies of the outdoor fans 26 such as the fan guards 2*k*. Therefore, the frost attaching to the fan guards 2*k* and the like is also warmed and thereby melts.

Further, the compressor 21 is herein activated. Therefore, the refrigerant flowing into the outdoor heat exchanger 23 keeps its temperature high and this enhances the defrosting performance. Yet further, the compressor 21 can compress the refrigerant in a warmed state by heating the accumulation pipe 10*f* using the electromagnetic induction heating unit 6. Therefore, the gas refrigerant discharged from the compressor 21 elevates its temperature and the refrigerant flowing into the outdoor heat exchanger 23 further elevates its temperature. This further enhances the defrosting performance. Consequently, a required time to melt the frost is reduced.

(Pressure Equalization Operation)

After completion of the fan defrosting operation, a pressure equalization operation is executed by deactivating the compressor 21 but activating the outdoor fans 26. It should be noted that the pressure equalization operation is executed after completion of the defrosting operation when the fan defrosting operation is not executed.

The rotation speed of the step 6, greater than the rotation speed during the fan defrosting operation, is selected as the rotation speed of the outdoor fans 26 during the pressure equalization operation. An object of the pressure equalization operation is to eliminate pressure difference within the refrigerant circuit 10 or reduce the pressure difference to be equal to or less than a predetermined value. In the present exemplary embodiment, the pressure equalization operation is executed until 80 seconds elapses or the pressure difference within the refrigerant circuit 10 is equal to or less than 0.49 MPa after completion of the fan defrosting operation. Suppose the refrigerant cycle is switched into the heating operation without executing the pressure equalization operation, the devices such as the four-way switching valve 22 are subjected to negative effects due to the impact of the pressure difference within the refrigerant circuit 10.

Prior to the pressure equalization operation, the compressor 21 preferably has a low operating frequency for quickly reducing the pressure difference within the refrigerant circuit 10 to be less than or equal to a predetermined value (0.49 MPa). In consideration of this, during the fan defrosting operation preceding the pressure equalization operation, the compressor 21 is set to have a specific operating frequency lower than the operating frequency during the defrosting operation.

<Features>

(1)

In the air conditioner 1, the controller 11 is configured to execute the fan defrosting operation control of activating the outdoor fans 26 for a preliminarily set period of time after completion of the defrosting operation when the outdoor temperature falls in a range of −5 to 5 degrees Celsius immediately before the start of the heating operation. Consequently, this results in melting of the frost attaching to the main bodies of the outdoor fans 26 and their peripheral members (e.g., bell mouths and fan guards).

(2)

During the fan defrosting operation, the controller 11 activates the compressor 21 at a specific operating frequency lower than the operating frequency during the defrosting operation. Consequently, the refrigerant flowing into the outdoor heat exchanger 23 keeps its temperature high. This inhibits reduction in temperature of the warmed air flowing towards the main bodies of the outdoor fans 26 and their peripheral members.

(3)

The controller 11 is configured to deactivate the compressor 21 after completion of the fan defrosting operation control and immediately before switching of the refrigeration cycle into the heating operation in order to execute the pressure equalization operation of reducing the pressure difference within the refrigerant circuit 10. Consequently, switching of the refrigeration cycle into the heating operation is safely executed.

INDUSTRIAL APPLICABILITY

The present invention is useful for the air conditioners intended to a cold and high humidity region.

What is claimed is:

1. An air conditioner comprising:

a refrigerant circuit arranged and configured to sequentially circulate a refrigerant through a compressor, an indoor heat exchanger, a decompression mechanism and an outdoor heat exchanger during a heating operation;

a switching valve connected to the refrigerant circuit to switch a flow direction of the refrigerant discharged from the compressor;

an outdoor fan; and a controller configured to execute a defrosting operation control in which the outdoor fan is deactivated and the switching valve directs the refrigerant discharged from the compressor towards the outdoor heat exchanger during a defrosting operation, the controller being further configured to maintain the switching valve so the refrigerant discharged from the compressor is directed towards the outdoor heat exchanger and to execute a fan defrosting operation control in which the outdoor fan is rotated for a predetermined period of time after completion of the defrosting operation when a predetermined condition is satisfied, and the compressor is activated at a specific operating frequency lower than an operating frequency during defrosting operation.

2. The air conditioner recited in claim 1, further comprising:

an outdoor temperature sensor configured to measure an outdoor temperature, the controller being further configured to execute the fan defrosting operation control when the outdoor temperature detected through the outdoor temperature sensor is in a predetermined temperature range.

3. The air conditioner recited in claim 1, wherein the controller is further configured to activate the compressor during the fan defrosting operation control.

4. The air conditioner recited in claim 3, wherein the controller is further configured to deactivate the compressor after completion of the fan defrosting operation control and before switching to the heating operation.

5. The air conditioner recited in claim 3, further comprising:

a refrigerant heating device arranged and configured to heat the refrigerant flowing through the refrigerant circuit, the controller being further configured to activate the refrigerant heating device during the fan defrosting operation control.

6. The air conditioner recited in claim, wherein the refrigerant heating device includes an electromagnetic induction heater.

7. The air conditioner recited in claim 1, wherein the predetermined period of time is selectable from options at least in an initial setting at an installation site of the air conditioner.

8. The air conditioner recited in claim 1, wherein the controller is further configured to deactivate the compressor after completion of the fan defrosting operation control and before switching to the heating operation.

9. The air conditioner recited in claim 1, further comprising:

a refrigerant heating device arranged and configured to heat the refrigerant flowing through the refrigerant circuit, the controller being further configured to activate the refrigerant heating device during the fan defrosting operation control.

10. The air conditioner recited in claim 9, wherein the refrigerant heating device includes an electromagnetic induction heater.

* * * * *

UNITED STATES PATENT AND TRADEMARK OFFICE

CERTIFICATE OF CORRECTION

PATENT NO. : 8,707,719 B2
APPLICATION NO. : 13/128500
DATED : April 29, 2014
INVENTOR(S) : Tsuyoshi Yamada et al.

It is certified that error appears in the above-identified patent and that said Letters Patent is hereby corrected as shown below:

In the Drawings

Please replace FIG. 2 with amended FIG. 2 attached.

Please replace FIG. 4 with amended FIG. 4 attached.

In the Claims

In Column 12, line 9, change “claim” to --claim 5--.

Signed and Sealed this
Tenth Day of February, 2015

Michelle K. Lee

Michelle K. Lee
*Deputy Director of the United States Patent and Trademark Office*